United States Patent [19]

Molloy

[11] Patent Number: 4,606,277

[45] Date of Patent: Aug. 19, 1986

[54] ACTUATING AND LOCKING APPARATUS FOR LONGITUDINAL HOPPER DOORS OF A RAILROAD HOPPER CAR

[75] Inventor: Robert E. Molloy, Cincinnati, Ohio

[73] Assignee: Ortner Freight Car Company, Milford, Ohio

[21] Appl. No.: 676,636

[22] Filed: Nov. 30, 1984

[51] Int. Cl.[4] ..... B61D 7/26

[52] U.S. Cl. ..... 105/290; 105/251; 105/312; 298/35 R; 298/37

[58] Field of Search ..... 105/286, 288, 289, 290, 105/304, 312, 247, 248, 250, 251, 299, 311 R; 298/35 R, 35 M, 37

[56] References Cited

U.S. PATENT DOCUMENTS

| | | | |
|---|---|---|---|
| 1,111,532 | 9/1914 | Frame et al. | 105/288 |
| 1,256,110 | 2/1918 | Cherbonnier | 105/312 |
| 2,602,403 | 7/1952 | Dorey | 105/312 |
| 3,455,253 | 7/1969 | Floehr | 105/304 |
| 3,543,691 | 12/1970 | Nagy | 105/290 |
| 3,596,609 | 8/1971 | Ortner | 105/304 |
| 3,717,109 | 2/1973 | Miller | 105/290 |
| 3,730,106 | 5/1973 | Tamborski | 105/304 |

*Primary Examiner*—Randolph A. Reese
*Assistant Examiner*—Dennis C. Rodgers
*Attorney, Agent, or Firm*—Frost & Jacobs

[57] ABSTRACT

An apparatus for actuating and locking pairs of hopper doors of a railroad hopper car of the type having a longitudinal center sill and pairs of longitudinally extending chutes, located opposite each other and on each side of the center sill, configured to discharge lading to each side of the hopper car, and each provided with a hopper door. Each chute of a pair is provided with a longitudinally extending shaft rotatively mounted on the underside thereof with first and second end portions extending beyond its chute. Both end portions of the shaft have an operating cam assembly non-rotatively mounted thereon and connected to the adjacent hopper door by an operating link. The operating cam assemblies at corresponding ends of the shafts are joined by connecting links. The first end of each shaft has a ratchet wheel and a capstain non-rotatively mounted thereon. Each chute of the pair has a ratchet pawl pivoted thereto and cooperating with its respective ratchet wheel. The ratchet pawls are interconnected so that both are simultaneously shifted between ratchet wheel engaging and releasing positions from either side of the hopper car. Each shaft and its operating cam assemblies is rotatable between door-open and over-center, door-closed positions. With the ratchet pawls in their releasing positions, both doors can be opened from either side of the hopper car by prying one of the operating cam assemblies on one of the shafts to its door-open position with an appropriate prying tool. With the ratchet pawls in their engaging positions, each door can be shifted to its over-center, door-closed position individually by means of its respective capstain and an appropriate tool.

16 Claims, 14 Drawing Figures

ACTUATING AND LOCKING APPARATUS FOR LONGITUDINAL HOPPER DOORS OF A RAILROAD HOPPER CAR

TECHNICAL FIELD

The invention relates to actuating and locking apparatus for the hopper doors of a railroad hopper car, and more particularly to such apparatus for the hopper doors of a railroad hopper car of the type having a longitudinal center sill and pairs of longitudinally extending chutes, located opposite each other on each side of the center sill, and each provided with its own hopper door.

BACKGROUND ART

Most conventional hopper cars fall into two basic categories: those cars having transversely extending hopper doors, and those cars having longitudinally extending hopper doors. In conventional hopper cars, latch means are provided, usually at opposite ends of each hopper door, to secure it in its closed position. When these latches are released by workmen, the door will swing downwardly to its open position under its own weight and under the weight of the lading pressing against the hopper door. When the load has been discharged, the hopper door must be moved manually to its closed position and re-latched on both sides.

Such a manual door opening and closing procedure has a number of inherent problems. For example, each hopper door is of substantial size and weight, with the result that considerable physical force is required to swing the hopper door from its open to its closed position. Another problem with a manual door opening operation lies in the fact that the hopper door hinge means are subjected to uneven wrenching or twisting forces if the latches on either side of the doors are not released simultaneously. Furthermore, such doors are sometimes latched on one side only, the other side being forgotten or inaccessible. These problems are magnified in newer and more advanced types of hopper cars which are characterized by increased size, greatly increased capacity, and larger and heavier hopper doors.

In recent years prior art workers have turned their attention to these problems and have devised various types of door opening systems to reduce or eliminate these problems. For example, U.S. Pat. No. 3,187,684 teaches a fully automatic door opening system for a hopper car having transverse doors arranged in opposed, cooperating pairs. U.S. Pat. No. 3,596,609 teaches another door actuating system for cooperating pairs of opposed hopper doors. This system can be applied to both transverse and longitudinal pairs of hopper doors. U.S. Pat. No. 4,366,757 teaches a manually operable door actuating and locking system for each opposed pair of hopper doors of a hopper car of the type having its hopper doors arranged in transversely extending opposed pairs.

The present invention is directed to the provision of a manually operable door actuating and locking apparatus for railroad hopper cars of the type having a longitudinal center sill and pairs of longitudinally extending chutes, located opposite each other and on each side of the center sill. The chutes of a pair are configured to discharge lading to each side of the hopper car, and each chute is provided with its own hopper door. The manually operable hopper door actuating and locking apparatus of the present invention enables the hopper doors of a pair of chutes located opposite each ofther to be unlocked and opened from one side of the hopper car. The apparatus requires each door of the pair to be closed from its respective side of the car, for safety reasons.

As used herein and in the claims, the term "manually operable" is intended to refer to actuating and locking means operable by one or more workmen provided with appropriate hand tools such as a pry bar or the like, as opposed to fully automatic systems of the type taught in the above mentioned U.S. Pat. Nos. 3,187,684 and 3,596,609.

DISCLOSURE OF THE INVENTION

According to the invention there is provided an apparatus for actuating and locking pairs of hopper doors of a railroad hopper car. The railroad hopper car is of the type having a longitudinal center sill and pairs of longitudinally extending chutes, located opposite each other on each side of the center sill. The chutes are configured to discharge lading to each side of the hopper car. Each chute of a pair is provided with a hopper door.

Each chute of a pair has a longitudinally extending shaft rotatably mounted on its under side, with first and second end portions extending beyond the chute. The first and second end portions of the shaft of each chute have an operating cam assembly non-rotatively mounted thereon. Each operating cam assembly is connected to the hopper door of its respective chute by an operating link. The operating cam assemblies at corresponding ends of the shafts of the pair of chutes are joined by connecting links.

The first end of each chute shaft has a ratchet wheel and a capstain non-rotatively mounted thereon. Each chute of the pair has a ratchet pawl pivoted thereto and cooperating with its respective ratchet wheel. The ratchet pawls are interconnected such that both are simultaneously shiftable between a ratchet wheel engaging position and a ratchet wheel releasing position from either side of the car.

Each shaft and its operating cam assemblies for each chute hopper door is rotatable between door-open position and an over-center, door-closed position. With the ratchet pawls in their releasing positions, both doors can be opened by prying one of the operating cam assemblies on one of the shafts to its door-open position with an appropriate prying tool. Thus, both hopper doors of a pair can be opened from one side of the car by one workmen. With the ratchet pawls in their engaging positions, a hopper door of the pair can be shifted to its over-center, door-closed position by engagement and rotation of its respective capstain with an appropriate tool. This will cause the other door of the pair to partially close. However, complete closure of the other door of the pair must be accomplished by engagement and rotation of its respective capstain with an appropriate tool. In this way, complete closure of both doors of the pair is assured since each door of the pair must be completely closed from its respective side of the hopper car, in full view of the workman.

DETAILED DESCRIPTION OF THE INVENTION

Figure 1:
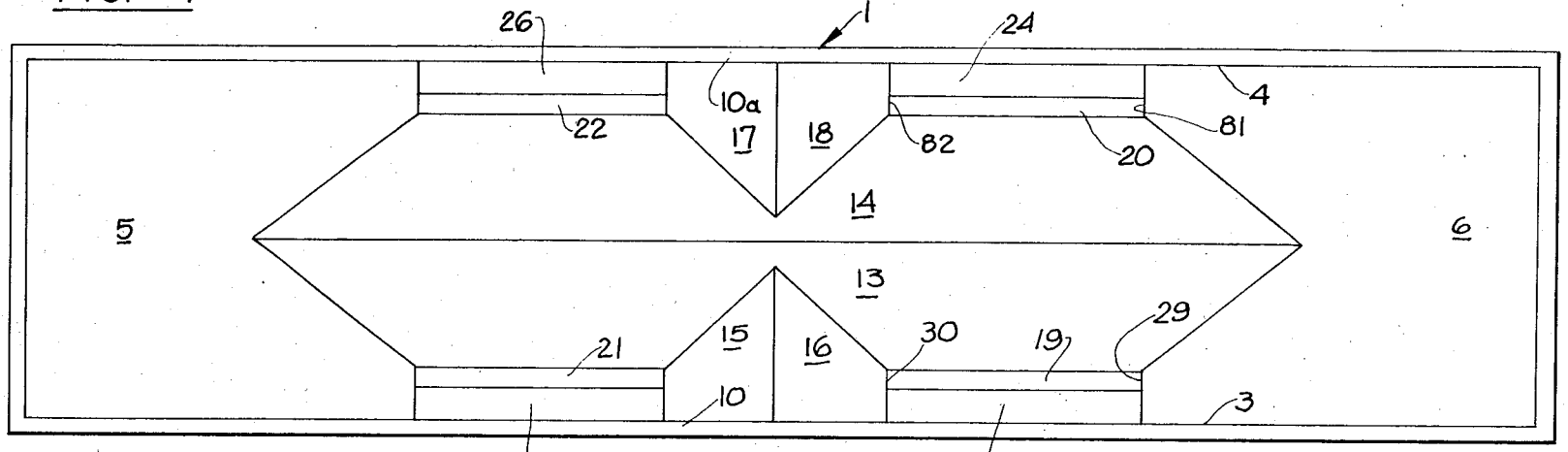
FIG. 1 is a plan view of an exemplary side-dump hopper car of the type to which the present invention is directed.
Figure 2:
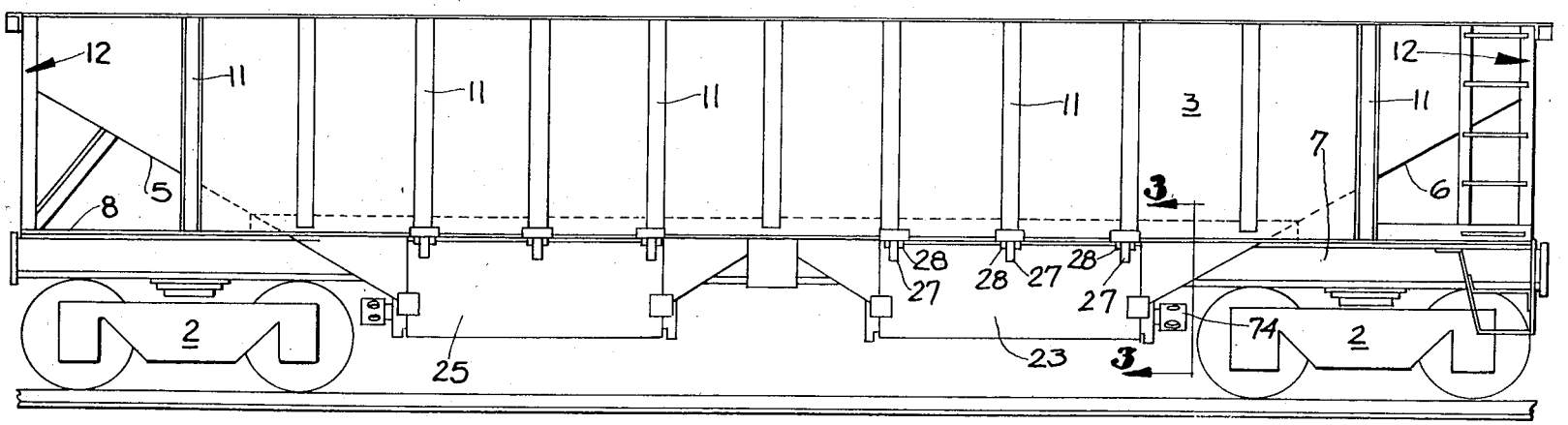
FIG. 2 is a side elevational view of the hopper car of FIG. 1.

An exemplary type of railroad hopper car to which the teachings of the present invention can be applied is shown in FIGS. 1 and 2. The hopper car, generally indicated at 1, comprises an elongated body mounted on conventional trucks 2. The body comprises sides 3 and 4 with inclined end walls or slope sheets 5 and 6.

Figure 14:
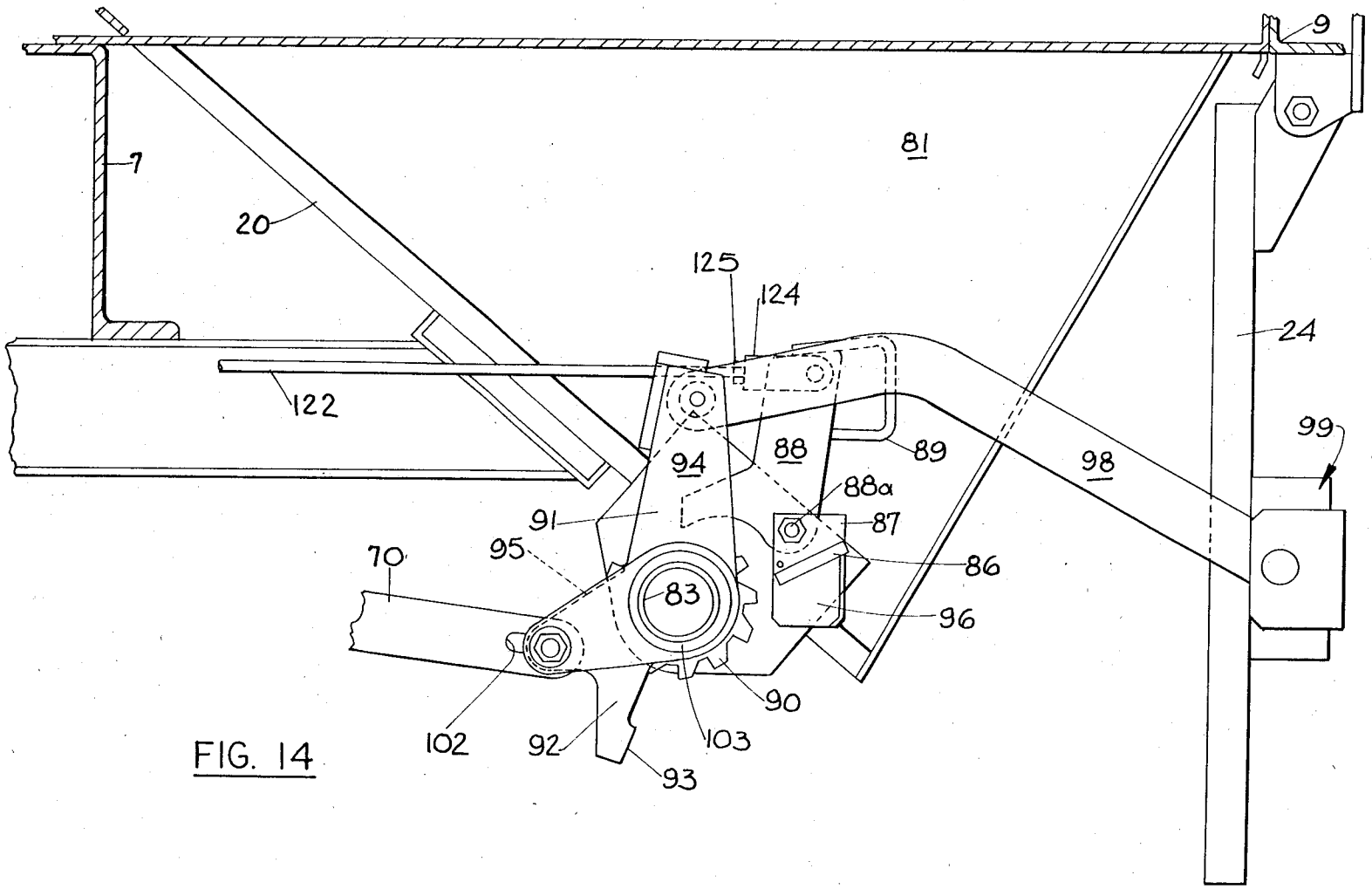
FIG. 14 is a fragmentary cross sectional view, similar to FIG. 4, and showing the second door of a pair and its portion of the actuating and locking apparatus in the door-open position.

The hopper car 1 is provided with a base frame comprising a longitudinally extending center sill 7, together with side sills extending parallel to and to either side of center sill 7. One of the side sills is shown at 8 in FIGS. 2 and 3, while the other side sill is shown at 9 in FIG. 14. The base frame also has a plurality of additional frame members (not shown) extending transversely of the hopper car 1 from the center sill 7 to the side sills 8 and 9, as is conventional. Center sill 7 may have any appropriate cross section. For purposes of an exemplary showing it is illustrated as having a hat-shaped cross section.

It will be understood by one skilled in the art that the ends of the car frame are provided with suitable bracing members (not shown). The sides 3 and 4 of hopper car 1 are reinforced by vertical brace members extending from the side sills 8 and 9 to the top chords 10 and 10*a*, respectively, of the hopper car 1. Such vertical side braces are shown at 11 for car side 3 in FIG. 2. The ends of the hopper car will also have vertical brace members, generally indicated at 12.

The bottom of the car body of hopper car 1 comprises slope sheets 5 and 6, a pair of oppositely slanted longitudinal slope sheets 13 and 14, and pairs of centrally located, transversely extending, oppositely slanted slope sheets 15–16 and 17–18. All of the slope sheets 5, 6 and 13 through 18 are arranged to conduct the lading toward pairs of chutes 19–20 and 21–22. The pair of chutes 19 and 20 are directly opposite each other on either side of center sill 7 and are configured to discharge the lading to either side of hopper car 1. The same is true of the pair of chutes 21 and 22. Each chute 19 and 20 of the pair is provided with a hopper door 23 and 24, respectively. The chutes 21 and 22 are similarly provided with hopper doors 25 and 26, respectively.

The door actuating and locking apparatus of the present invention is adapted to actuate and lock a pair of doors. Thus, there will be an actuating and locking apparatus for hopper doors 23 and 24 and a second actuating and locking apparatus for hopper doors 25 and 26. The actuating and locking apparatus for hopper doors 23 and 24 is identical to that for hopper doors 25 and 26. Therefore, a description of the actuating and locking apparatus for hopper doors 23 and 24 should suffice to adequately set forth the nature of the invention, and may be considered a description of the actuating and locking apparatus for the pair of hopper doors 25 and 26, as well.

Figure 3:
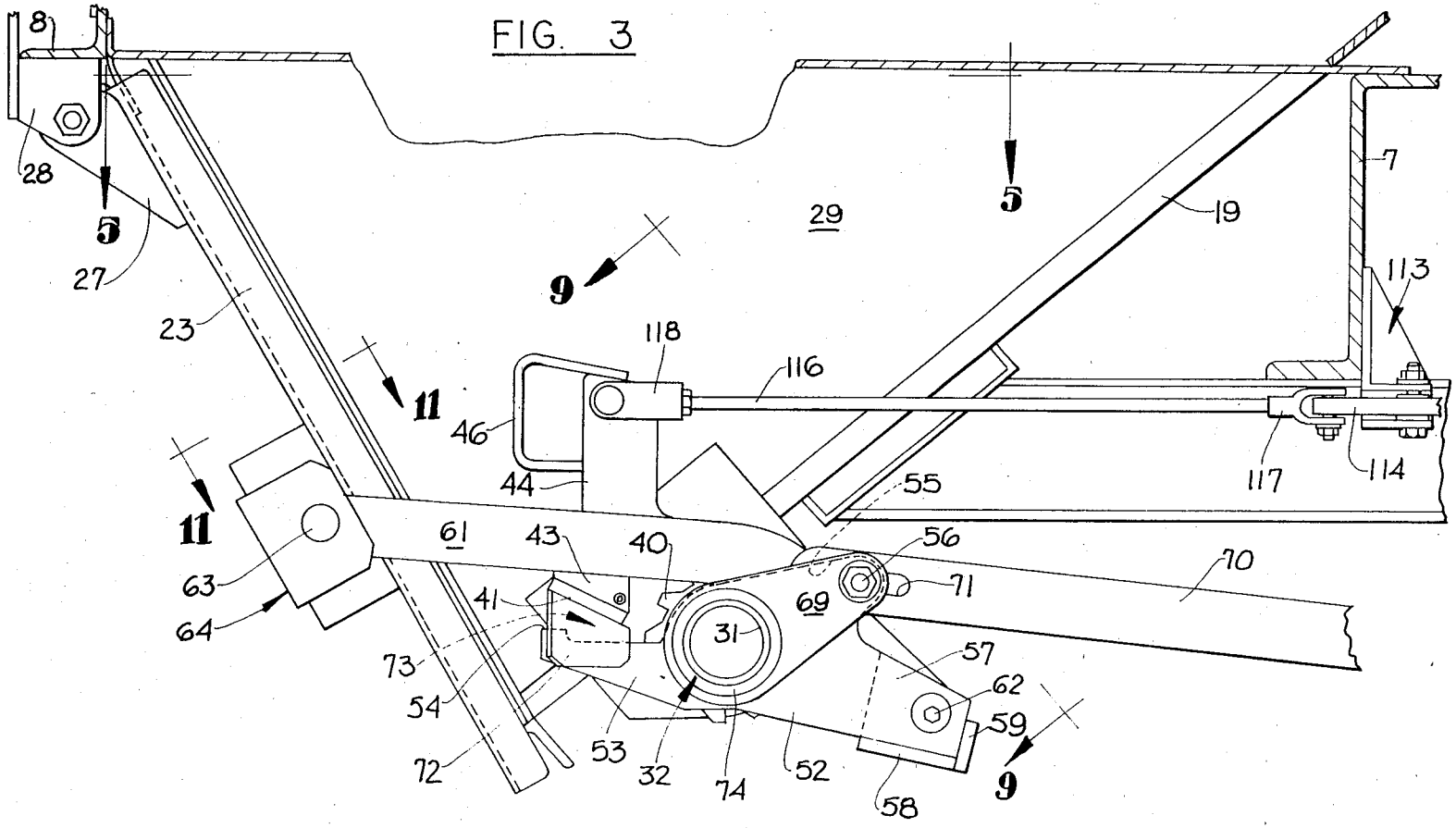
FIG. 3 is a fragmentary cross sectional view taken along section line 3—3 of FIG. 2 and illustrates the first hopper door of a pair and its respective portion of the actuating and locking apparatus in their over-center, door-closed positions.
Figure 5:
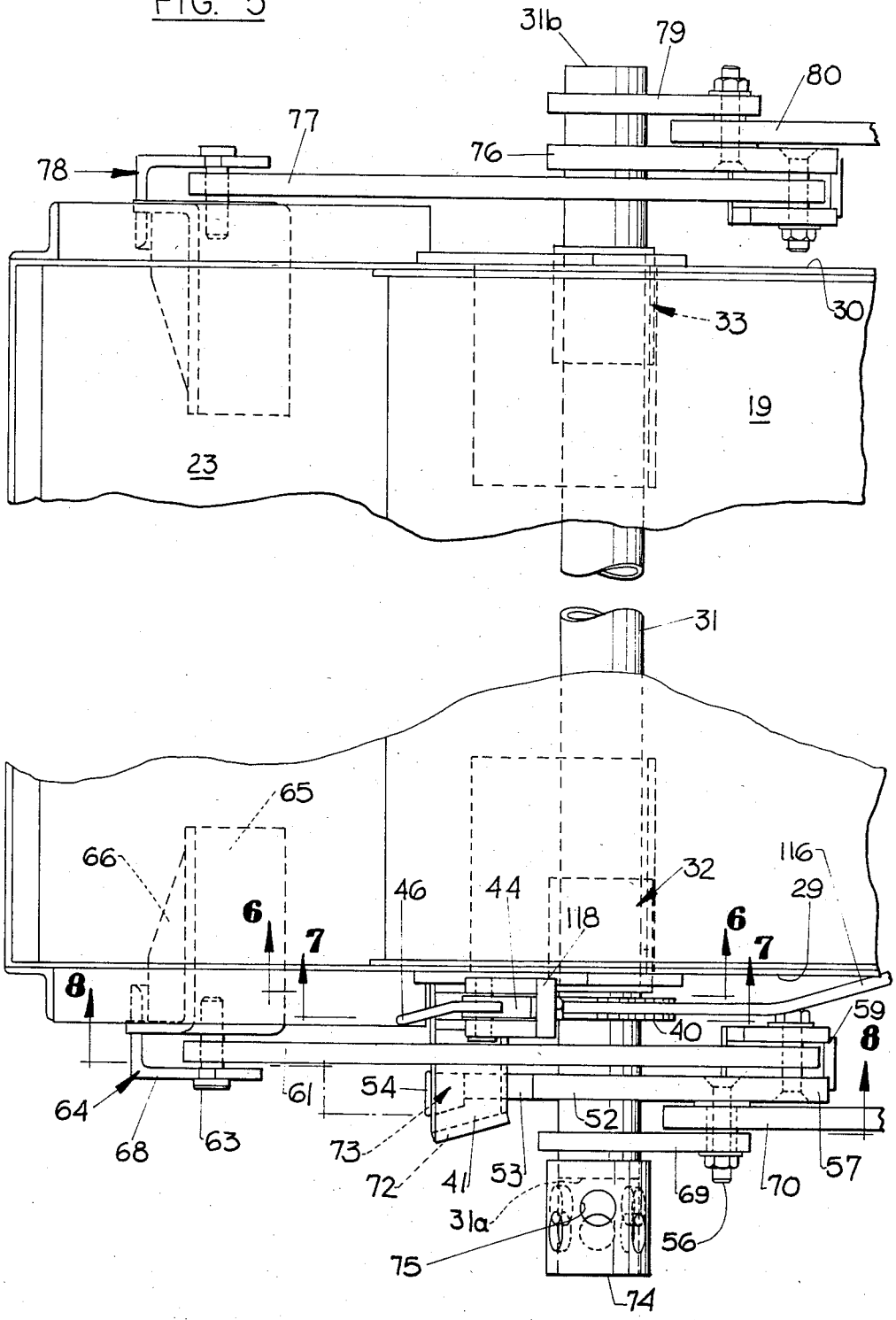
FIG. 5 is a fragmentary cross sectional view taken along section line 5—5 of FIG. 3.
Figure 13:
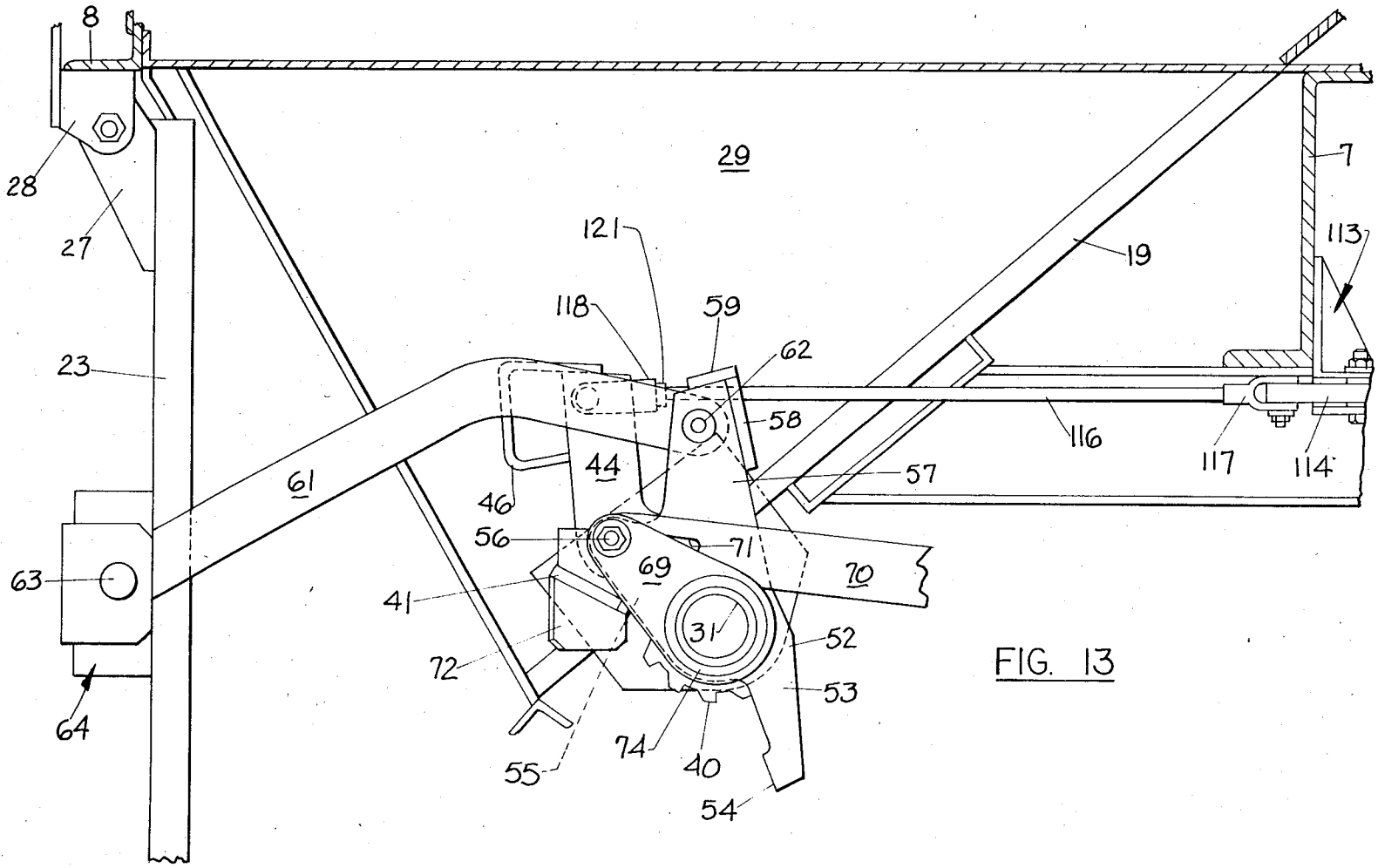
FIG. 13 is a fragmentary cross sectional view, similar to FIG. 3, and showing the first hopper door of a pair and its portion of the actuating and locking apparatus in the door-open position.

Reference is now made to FIGS. 3 and 5 wherein like parts have been given like index numerals. FIGS. 3 and 5 illustrate chute 19 and hopper door 23. The upper longitudinal edge of hopper door 23 is provided with a series of hinge members 27, cooperating with hinge members 28 affixed to side sill 8 (see also FIG. 2). Thus, the door 23 is hingedly affixed to the side sill 8 and is swingable between a closed position shown in FIG. 3 and an open position shown in FIG. 13. The chute 19 is completed by vertical hopper sheets 29 and 30 located at each of its ends.

Figure 6:
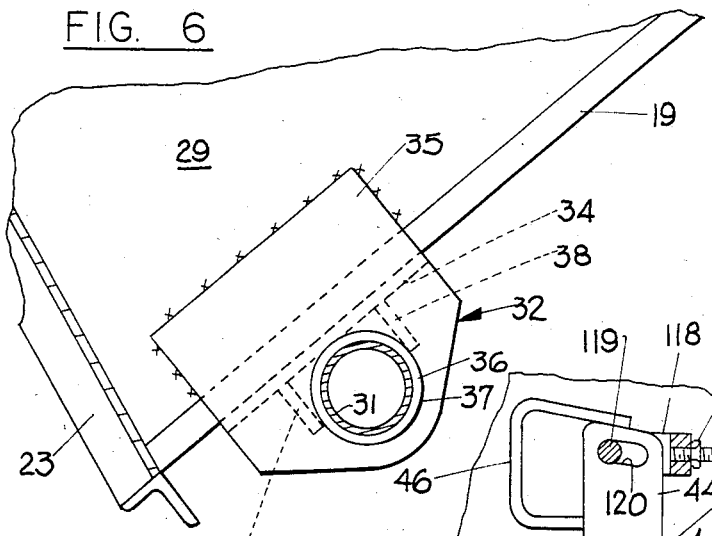
FIG. 6 is a fragmentary cross sectional view taken along section line 6—6 of FIG. 5.

At this point, that much of the actuating and locking apparatus which is specifically associated with chute 19 and hopper door 23 will next be described. To this end, an elongated cylindrical shaft 31 is mounted for rotation on the underside of chute 19 in bearings generally indicated at 32 and 33. The bearing 32 is most clearly shown in FIGS. 6 and 9. The bearing 32 comprises a plate 34 affixed to the underside of chute 19, and also affixed to a plate 35, oriented at 90° to the plate 34 and mounted on hopper sheet 29. A cylindrical bearing sleeve 36 lies along the plate 34 and passes through an opening 37 in plate 35, being affixed to both plates 34 and 35. A pair of brace members 38 and 39 flank and are affixed to the bearing sleeve 36 and are additionally attached to the plate 34.

Returning to FIG. 5, it will be understood that the bearing 33 is identical to bearing 32 and is mounted on the chute 19 and hopper sheet 30. The shaft 31, mounted in bearings 32 and 33, extends parallel to the center sill 7, and terminates in ends 31*a* and 31*b* extending beyond the confines of hopper sheets 29 and 30.

Figure 7:
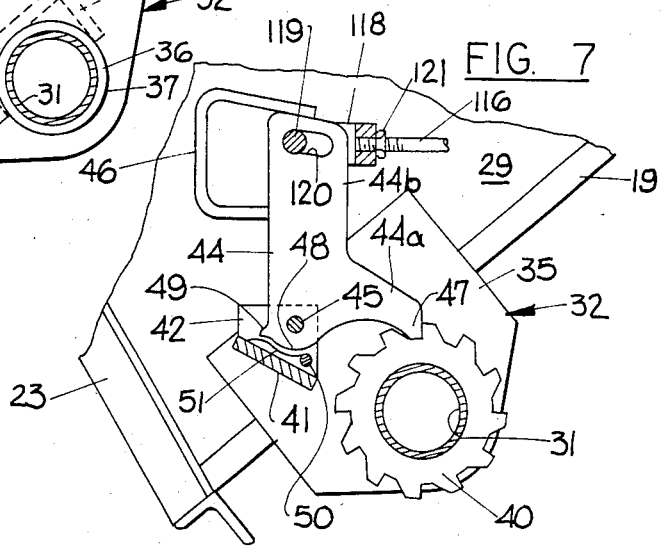
FIG. 7 is a fragmentary cross sectional view taken along section line 7—7 of FIG. 5.

Reference is now made to FIGS. 3, 5 and 7. Mounted on that end of shaft 31 extending beyond hopper sheet 29 and terminating in end 31*a*, there is a toothed ratchet wheel 40. Adjacent the ratchet wheel 40 there is a plate 41 affixed to the plate 35 of bearing 32 and extending perpendicular thereto. As is most clearly shown in FIG. 7, the plate 41 slopes downwardly and inwardly toward the toothed ratchet wheel 40. The upper surface of plate 41 carries a pair of upstanding lugs 42 and 43 (see also FIG. 9). A ratchet pawl 44 is pivotally mounted between lugs 42 and 43 by a bolt 45.

The ratchet pawl 44 is generally L-shaped having a laterally extending leg 44*a* and a substantially vertically extending leg 44*b*. Near its upper end, the leg 44*b* has a bail-like handle 46 affixed thereto. The lateral leg 44*a* terminates in a foot 47 adapted to engage the teeth of ratchet wheel 40. Adjacent the pivot pin or bolt 45 the ratchet pawl 44 has a rounded nose portion 48 and a laterally extending lug 49. As is most clearly shown in FIG. 7, mounted on a pin 50 extending between lugs 42 and 43 there is a leaf spring 51 of S-shape, located between the lugs 42 and 43. As will be apparent hereinafter, the ratchet pawl 44 is rotatable about its pivot pin or bolt 45 between a ratchet wheel engaging position shown in FIG. 7 and a counterclockwise position wherein the foot 47 does not engage the teeth of ratchet wheel 40. The spring 51 cooperates with rounded portion 48 of ratchet pawl 44 to maintain the ratchet pawl in its ratchet wheel engaging position, even when the ratchet wheel is being rotated in a clockwise direction, as viewed in FIG. 7. The extension 49 of the ratchet pawl 44 will cooperate with spring 51 to maintain the ratchet pawl 44 in its releasing position, when pulled thereto manually by means of the ratchet pawl handle 46.

Figure 8:
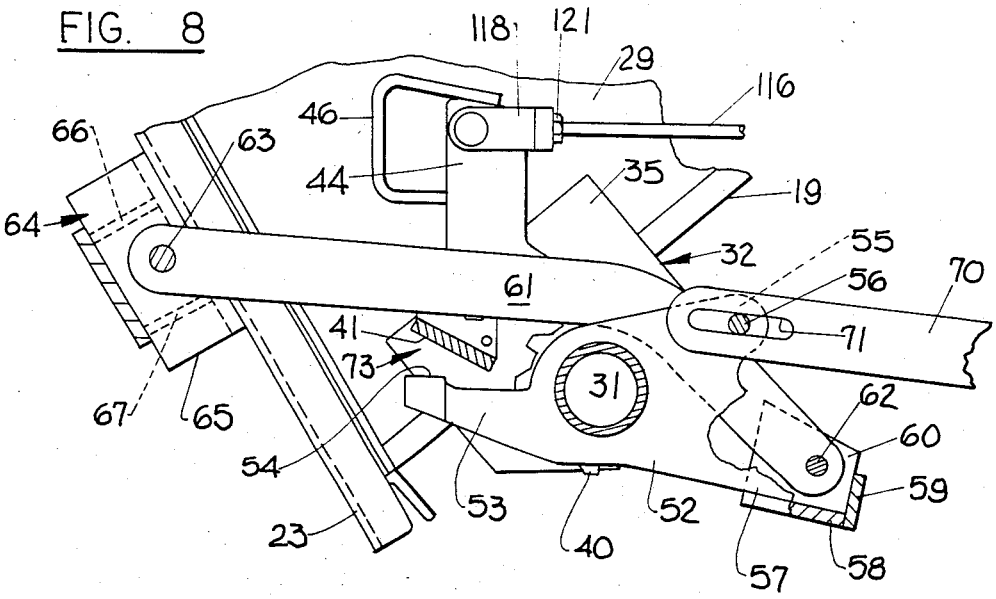
FIG. 8 is a fragmentary cross sectional view taken along section line 8—8 of FIG. 5.

Reference is now made to FIGS. 3, 5 and 8. Outboard of ratchet wheel 40 on that portion of shaft 31 which terminates in end 31*a*, there is non-rotatively mounted an operating cam 52. The operating cam 52 has a first arm or extension 53 terminating in a prying surface 54. The operating cam 52 has a second arm or extension 55, carrying a pivot pin or bolt 56, the purpose of which will be apparent hereinafter. Finally, the operating cam 52 has a third arm or extension 57. At its free end, a pair of plates 58 and 59 are fixed to the arm 57 the plates 58 and 59 support an additional plate 60, parallel to and spaced from the free end of arm 57.

An L-shaped door actuating lever 61 is provided. One end of the door actuating lever 61 is pivotally attached between the free end of operating cam arm 57 and plate 60 by a pivot pin or bolt 62. The other end of the door actuating lever 61 is pivotally attached by means of pivot pin or bolt 63 to a hinge assembly (generally indicated at 64) affixed to door 23.

Figure 11:
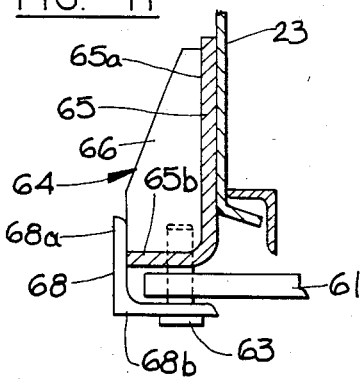
FIG. 11 is a fragmentary cross sectional view taken along section line 11—11 of FIG. 3.

The hinge assembly 64 is probably best shown in FIGS. 5, 8 and 11. Hinge assembly 64 comprises an angle iron 65 having a long leg 65*a* affixed to the exterior of door 23 and a short leg 65*b* extending outwardly of the door 23. The angle iron 65 is additionally strengthened by a pair of gussets 66 and 67. Affixed to the end of the short leg 65*b* of angle iron 65 and to the gussets 66 and 67 there is a second angle iron 68. The angle iron 68 has a first leg 68*a* by which it is affixed to angle iron 65 and gussets 66 and 67 and a second leg 68*b* parallel to and spaced from the leg 65*b* of angle iron 65. The end of door actuating link 61 is located between angle iron legs 65*b* and 68*b* through which pivot pin 63 extends.

Figure 9:
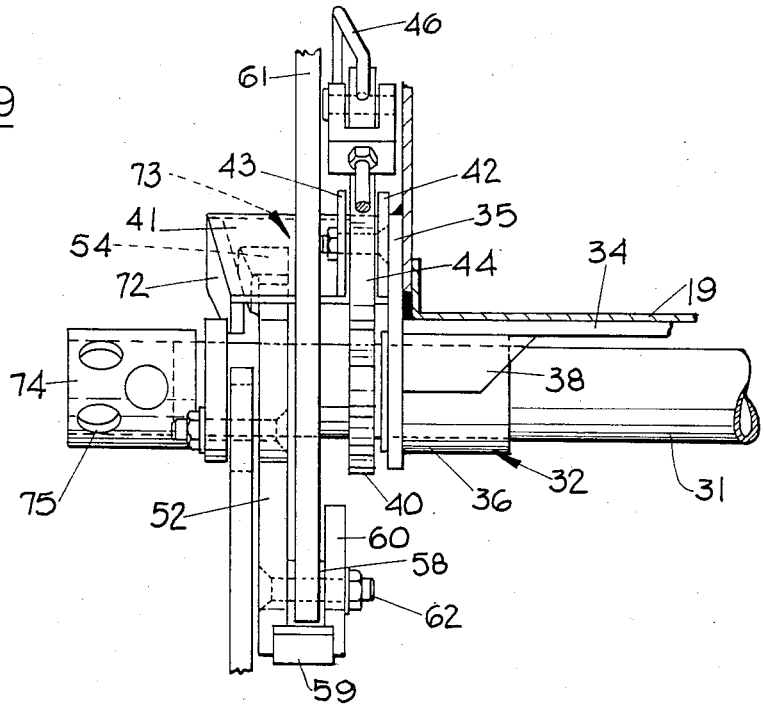
FIG. 9 is a fragmentary cross sectional view taken along section line 9—9 of FIG. 3.

Reference is now made to FIGS. 3, 5 and 9. Outboard of operating cam 52 there is non-rotatively mounted on shaft 31 an arm 69. The free end of arm 69 is equivalent to and is in parallel spaced relationship with the arm or extension 55 of operating cam 52. The pivot pin 56 extends through the free end of operating cam arm or extension 55 and the free end of arm 69. Between these last two mentioned elements there is a connecting link 70. The pivot pin or bolt 56 passes through an elongated slot 71 in the end of connecting link 70. The purpose of connecting link 70 will be apparent hereinafter.

Reference is now made to FIGS. 3, 5, 8 and 9. It will be noted from FIGS. 3, 5 and 9 that the end of plate 41 which extends from bearing plate 35 has a downwardly depending lug 72 affixed thereto. It will be apparent from these figures that the prying surface 54 of operating cam 52, the lug 72 and the underside of plate 41 form a socket, generally indicated at 73, into which the end of a pry bar may be inserted, for purposes to be described hereinafter.

Reference is now made to FIGS. 3, 5 and 9. Outboard of the arm 69, the shaft 31 carries a capstain 74. The capstain 74 comprises a hollow cylindrical member non-rotatively affixed to the shaft 31 and having a plurality of opening 75 about its periphery into which an elongated rod-like tool can be inserted, for purposes which will be apparent hereinafter.

To complete that portion of the actuating and locking apparatus of the present invention associated with chute 19 and hopper door 23, reference is made to FIG. 5. That end of shaft 31 which extends beyond hopper sheet 30 and terminates in shaft end 31*b* has an operating cam 76 non-rotatively affixed thereto. The operating cam 76 is identical to operating cam 52 with two exceptions. First of all, it is a mirror image of operating cam 52. Secondly, the operating cam 76 does not have an arm equivalent to arm 53 of operating cam 52, terminating in prying surface 54. Pivotally affixed to operating cam 76 there is a door actuating link 77, identical to door actuating link 61. The door actuating link 77 is pivotally affixed to a hinge assembly generally indicated at 78. The hinge assembly 78 is mounted on hopper door 23 and is identical to hinge assembly 64. Outboard of operating cam 76, an arm 79 is non-rotatively mounted on shaft 31. The arm 79 is identical to arm 69. A connecting link 80, identical to connecting link 70, is pivoted between operating cam 76 and arm 79 in the same manner described with respect to the pivotal attachment of connecting link 70 between operating cam 52 and arm 69.

Figure 4:
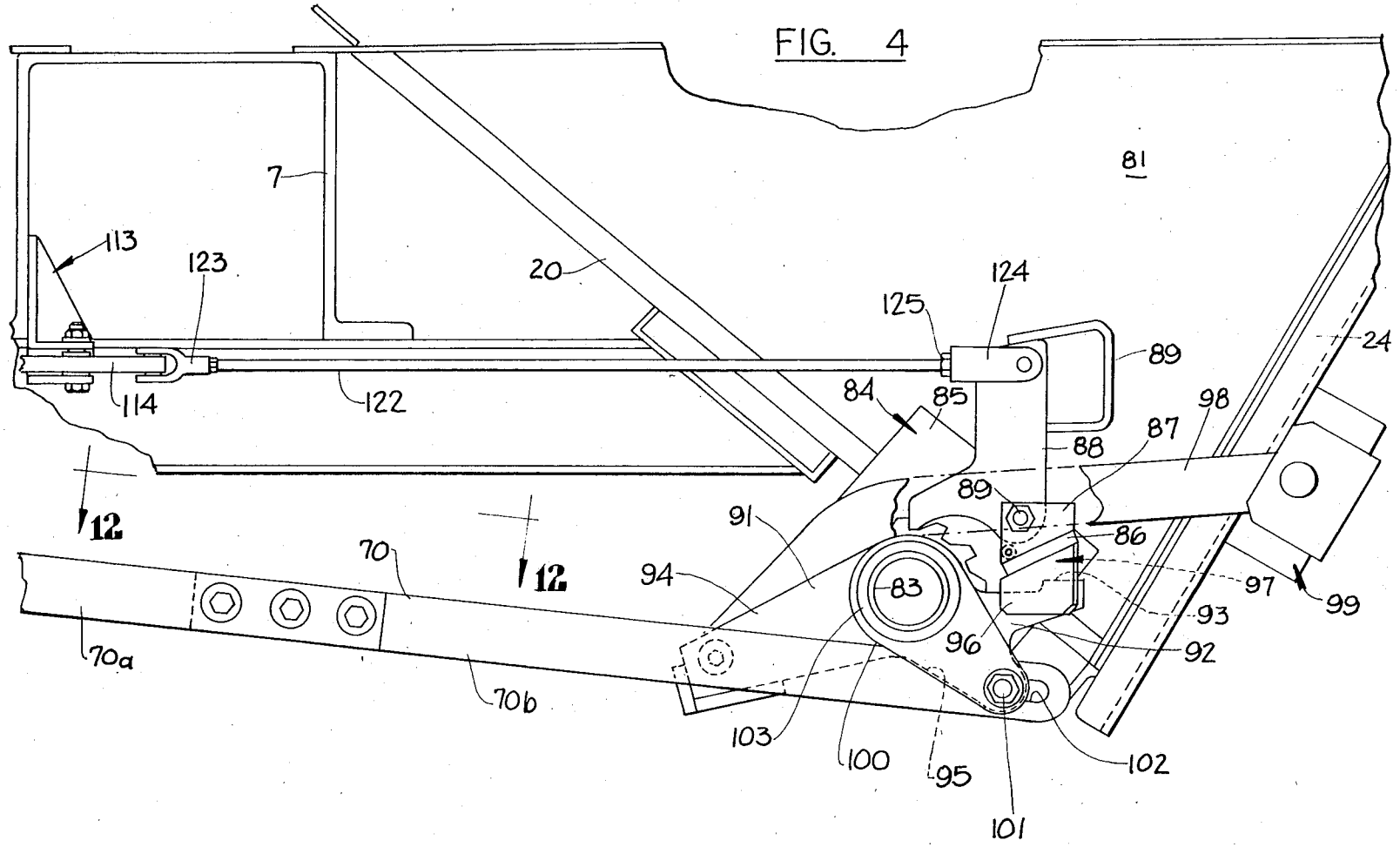
FIG. 4 is a fragmentary cross sectional view, similar to FIG. 3, and showing the second door of a pair and its portion of the actuating and locking apparatus in their over-center, door-closed positions.

Reference is now made to FIG. 4, which illustrates that part of the actuating and locking apparatus of the present invention associated with chute 20 and hopper door 24. The chute 20 is provided at its ends with vertical hopper sheets 81 and 82 (see also FIG. 1). A shaft 83, identical to shaft 31, is mounted beneath chute 20 by bearing means identical to bearing means 32 and 33, one of which is generally indicated at 84. Mounted on the bearing plate 85 of bearing means 84 there is a plate 86, identical to plate 41. The plate 86 is provided with a pair of upstanding lugs similar to lugs 42 and 43 of FIG. 9, one of which is shown at 87. A ratchet pawl 88 is pivotally affixed between these lugs by pivot pin 88*a*. The ratchet pawl 88 is identical to ratchet pawl 44 and is provided with a handle 89 in similar fashion. The lugs mounted on plate 86, one of which is shown at 87, support a leaf spring (not shown) identical to leaf spring 51 for ratchet pawl 44. The ratchet pawl 88 cooperates with a toothed ratchet wheel 90, non-rotatively affixed to shaft 83 and fully equivalent to ratchet wheel 40. Outboard of ratchet wheel 90, an operating cam 91 is non-rotatively affixed to shaft 83. The operating cam 91 has a first arm or extension 92 equivalent to the arm or extension 53 of operating cam 52 and providing a prying surface 93. The operating cam 91 has a second arm 94 equivalent to operating cam arm 57 of FIG. 3. Finally, the operating cam 91 has a third arm 95 equivalent to arm 55 of operating cam 52. The operating cam 91 differs from operating cam 52 only in the radial positioning of its arms 92, 94 and 95.

With respect to operating cam arm 92, it will be noted that the plate 86 has a downwardly depending lug 96 equivalent to downwardly depending lug 72 of FIG. 3. The prying surface 93 of operating cam arm 92, together with lug 96 and the underside of plate 86 form a socket, generally indicated at 97. The socket 97 is similar to an serves the same purpose as socket 73 of FIG. 3. The operating cam arm 94 pivotally mounts one end of a door actuating link 98, identical to door actuating link 61 of FIG. 3. The other end of door actuating link 98 is pivotally affixed to a hinge element generally indicated at 99. Again, the hinge element 99 is identical to the hinge elemenet 64 of FIG. 3.

Outboard of operating cam 91, an arm 100 is non-rotatively affixed to the shaft 83. The arm 100 is identical to the arm 69 of FIG. 3 and serves the same purpose. To this end, the arm 95 of operating cam 91 and the arm 100 carry a pivot pin or bolt 101 which extends through an elongated slot 102 in the other end of connecting link 70. Finally, outboard of arm 100, the shaft 83 carries a capstain 103 identical to capstain 74.

The other end of shaft 83 is not shown in the figures. It will be understood, however, that the other end of shaft 83 will carry an operating cam equivalent to operating cam 76 of FIG. 5 and an arm equivalent to arm 79 of FIG. 5. The operating cam will pivotally support one end of a door actuating link equivalent to door actuating link 77 of FIG. 5. The other end of the door actuating link will be pivotally affixed to a hinge element mounted on door 24 and substantially identical to hinge element 99. The actuating cam and arm mounted on that end of shaft 83 not shown will also pivotally engage the other end of connecting link 80 of FIG. 5.

Figure 12:
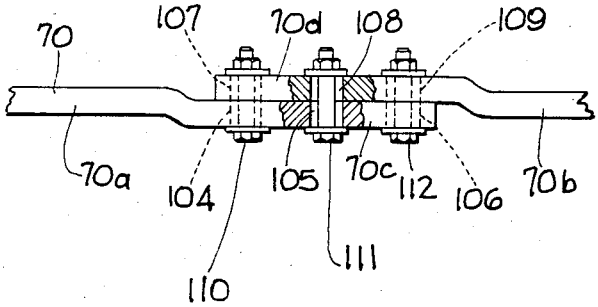
FIG. 12 is a fragmentary view of the connecting link as seen in accordance with reference line 12—12 of FIG. 4.

Reference is now made to FIGS. 4 and 12. As will be apparent from these figures, the connecting link 70 is made up of two halves, 70*a* and 70*b*. At the center of connecting link 70, the halves 70*a* and 70*b* have off-set end portions 70*c* and 70*d* which overlap. The end portion 70*c* has three elongated perforations 104, 105 and 106. In similar fashion the end portion 70*d* has three corresponding elongated holes 107, 108 and 109. Bolts 110, 111 and 112 pass through perforations 104–107, 105–108 and 106–109, respectively. This arrangement enabls a fine adjustment in the overall length of connecting link 70.

Reference is now made to FIGS. 3, 4, 7 and 10. A bracket means, generally indicated at 113 is affixed to an inside surface of center sill 7. The bracket 113 pivotally mounts a transfer lever 114, as at 115. A link 116 is provided with a clevis 117 at one end, by which it is pivotally attached to one end of transfer lever 114. The link 116 is provided with a clevis 118 at its other end, by which it is pivotally attached to ratchet pawl 44. As is most clearly shown in FIG. 7, the clevis 118 is provided with a pivot pin 119 which passes through an elongated slot 120 in ratchet pawl 44. The end of link 116 connected to clevis 118 is threadedly engaged in the clevis 118 and is held in place by a jam nut 121. A second link 122, similar to link 116, is provided at one end with a clevis 123 by which it is pivotally attached to the other end of transfer lever 114. At its other end, the link 122 is provided with a clevis 124, by which it is connected to ratchet pawl 88 in a manner identical to that described with respect to ratchet pawl 44. A jam nut 125 is provided. The jam nuts 121 and 125 enable fine adjustment of this linkage.

Figure 10:
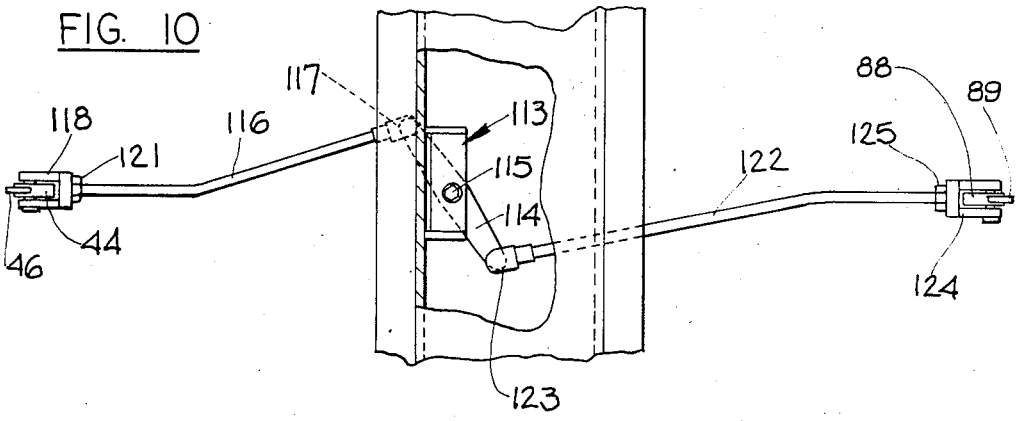
FIG. 10 is a fragmentary plan view illustrating a portion of the center sill and the transfer lever and links connecting the ratchet pawls of the present invention.

From the structure just described, and in view of FIG. 10, it will be apparent that when ratchet pawl 44 is shifted by its handle 46 into engagement with toothed ratchet wheel 40, ratchet pawl 88 will be simultaneously shifted to its engaging position with respect to toothed ratchet wheel 90. Similarly, if ratchet pawl 44 is shifted by its handle 46 to its releasing position, ratchet pawl 88 will be shifted to its releasing position simultaneously. By the same token, ratchet pawl 88 may be shifted manually by means of its handle 89 between engaging and releasing positions, which will cause simultaneous shifting of ratchet pawl 44 to corresponding engaging and releasing positions.

The actuating and locking apparatus of the present invention (associated with the pair of hopper doors 23 and 24) having been fully described, its mode of operation may now be set forth. FIGS. 3 and 4 illustrate hopper doors 23 and 24, and there associated actuating and locking apparatus in their closed and latched positions. It will be noted that toothed ratchet wheels 40 and 90 (and thus shafts 31 and 83) are precluded from rotating in a door-opening direction, by virtue of the fact that they are engaged by their respective ratchet pawls 44 and 88. The mechanism is therefore locked. In addition to this, the weight of the doors 23 and 24, themselves, and the weight of the lading thereagainst (if the car is full), tend to urge the doors 23 and 24 to their closed positions. This is true because of the over-center positions of the door actuating and locking apparatus. Thus, an imaginary line passing through the axis of pivot pin or bolt 63 which joins the actuating link 61 to door 23, and through the axis of pivot pin or bolt 62 which joins the other end of actuating link 61 to the arm 57 of operating cam 52 lies just below the axis of shaft 31 (see FIG. 3). Similarly, it is evident from FIG. 4 that a line through the pivots of the ends of actuating link 98 lies just below the axis of shaft 83 (see FIG. 4).

The door opening sequence may be described as follows. First of all, it is necessary to release shafts 31 and 83 so that they are free to turn in a door-opening direction. As viewed in FIG. 3, the shaft 31 must be rotatable in a counterclockwise direction. As viewed in FIG. 4, the shaft 83 must be rotatable in a clockwise direction. To accomplish this, handle 46 of ratchet pawl 44 is pulled, causing the ratchet pawl to rotate in a counterclockwise direction (see FIG. 3) sufficiently to disengage the ratchet pawl foot 47 from the teeth of ratchet wheel 40. When this is done, by virtue of links 116 and 122 and transfer lever 114 (see FIG. 10), ratchet pawl 88 will be rotated in a clockwise direction as viewed in FIG. 4, removing its foot portion from the teeth of ratchet wheel 90. The same shaft unlocking process can be achieved by grasping the handle 89 of ratchet pawl 88 and causing the ratchet pawl 88 to rotate in a clockwise direction as viewed in FIG. 4. Thus, the shafts 31 and 83 can be unlocked from either side of the hopper car.

Assuming that a workman is standing adjacent door 23, once the shafts 31 and 83 have been released, it is only necessary for the workman to insert the end of a pry bar into socket 73 formed by the underside of plate 41, the lug 72 and the prying surface 54 of actuating cam 52. By rotating the pry bar downwardly, the actuating cam 52 is rotated in a counterclockwise direction (as viewed in FIG. 3) until such time as the imaginary line through pivot pins or bolts 62 and 63 pass above the axis of shaft 31 (i.e. through center). From this point on, door 23 will open under its own weight and the weight of the lading, if the car is loaded. When door 23 is about half open, pivot pin 56 of operating cam 52 and arm 69 will reach the end of its slot 71 in connecting link 70 (FIG. 3), and pivot pin 101 of operating cam 91 and arm 100 will reach the end of its slot 102 in connecting link 70 (see FIG. 4). The momentum of hopper door 23 will be sufficient to enable connecting link 70 to pivot operating cam 91 in a clockwise direction (as shown in FIG. 4) until the imaginary line through the axes of the pivot pins at the ends of actuating link 98 passes above the axis of shaft 83 (i.e. through center). At this point, hopper door 24 will continue to its open position under its own weight and the weight of the lading, if the car is loaded. This is made possible by virtue of the elongated slots 71 and 102 at the ends of connecting link 70. When hopper doors 23 and 24 are fully open, they and their respective portions of the actuating and locking apparatus of the present invention will assume the positions illustrated in FIGS. 13 and 14.

It will be understood that the hopper doors 23 and 24 can be opened in a similar manner by a workman standing adjacent hopper door 24. Once the shafts 31 and 83 have been released, the workman may insert the end of a pry bar into socket 97 formed by the underside of plate 86, the lug 96 and the prying surface 93 of operating cam 91. A downward movement of the pry bar will cause the operating cam 91 to rotate in a clockwise direction until the imaginary line through the pivot pins at the ends of actuating link 98 shift to a position above the axis of shaft 83 (i.e. through center). At this point, door 24 will continue to its fully open position under its own weight and the weight of the lading, if the car is loaded. When hopper door 24 is about half open, the connecting link 70 will operate in the same manner described above to cause operating cam 52 to rotate in a counterclockwise direction through center. From this point on, door 23 will shift to its fully open position under its own weight and under the weight of the lading, if the car is loaded.

The door closing sequence can now be described. With the hopper doors in their open positions shown in FIGS. 13 and 14, the first step in the door closing sequence is to shift the ratchet pawls 44 and 88 to their engaging positions, with their foot portions engaging the teeth of ratchet wheels 40 and 90, respectively. This can be accomplished simply by grasping the handle 46 of ratchet pawl 44 and rotating the ratchet pawl in a clockwise direction as viewed in FIG. 13. The links 116 and 122 and the transfer lever 114 will cause the ratchet pawl 88 to shift to its engaging position in a counterclockwise direction. The same is of course true if the handle 89 of ratchet pawl 88 is grasped and the ratchet pawl is caused to rotate in a counterclockwise direction to its engaging position. In a similar fashion links 116 and 122 and transfer lever 114 will cause pawl 44 to rotate in a clockwise direction to its engaging position.

With ratchet pawls 44 and 88 in their engaging positions, shafts 31 and 83 are precluded from rotating in a door-opening direction. However, they both are free to rotate in a door closing direction (i.e. a clockwise direction for shaft 31 as viewed in FIG. 13 and a counterclockwise direction for shaft 83 as viewed in FIG. 14).

A workman standing adjacent hopper door 23 next inserts an appropriate tool (it may be the same pry bar) into an appropriate pair of perforations in capstain 74. Shifting the tool upwardly, and thereby causing the shaft 31 to rotate in a clockwise direction as viewed in FIG. 13. Ratchet pawl 44, engaging ratchet wheel 40 will hold the mechanism in semi-closed position while the tool is repositioned with respect to the capstain for best leverage. The capstain is rotated by the workman until door 23 and its respective portion of the actuating and locking mechanism achieves the over-center, door-closed position shown in FIG. 3. When door 23 is about half closed, connecting link 70 will begin to rotate operating cam 91 of door 24, initiating the shifting of door 24 to its closed position. When door 23 is in its fully closed over-center position, door 24 will be about half closed. At this point it will be necessary for a workman standing adjacent door 24 to engage capstain 103 with an appropriate tool and rotate the capstain (and thus shaft 83) in a counterclockwise direction until door 24 achieves its over-center, fully closed position.

It will be understood by one skilled in the art that an operator standing adjacent door 24 can engage capstain 103 and rotate shaft 83 until door 24 achieves its over-center, fully closed position as shown in FIG. 4. In the same manner just described, when door 24 is about half closed, movement of door 23 toward its closed position will be initiated by virtue of connecting link 70. When the door 24 is fully closed, door 23 will be about half closed. It will then be necessary for a workman adjacent door 23 to engage capstain 74 and rotate it and shaft 31 in a clockwise direction as viewed in FIG. 13, until door 23 achieves its over-center, fully closed position shown in FIG. 3.

The hopper car 1 of FIGS. 1 and 2 is illustrated as having two sets of hopper doors 23–24 and 25–26. The car 1 could, of course, have additional pairs of hopper doors, each provided with its own door actuating and locking mechanism.

In the embodiment shown, the door actuating and locking mechanism for the pair of hopper doors 23 and 24 are illustrated as having ratchet wheels 40 and 90, ratchet pawls 44 and 88, and operating cams 52 and 91 with prying surfaces 54 and 93, respectively, located at those ends of shafts 31 and 83 near the adjacent end of the hopper car. It will be understood that these elements could be located at the other ends of shafts 31 and 83, near the center of hopper car 1. Preferably, however, these elements are located as illustrated, and the corresponding elements on the actuating and locking mechanism for the pair of hopper doors 25 and 26 will be similarly located. It will be evident from this disclosure that uneven wrenching of hopper doors 23 and 24 is precluded by the actuating and locking apparatus of the present invention.

Modifications may be made in the invention without departing from the spirit of it. For example, the hinge elements 64 and 78 of hopper door 23 and the bearing means 32 and 33 of chute 19 could each constitute one piece integral castings. This is also true of operating cam 52 and arm 69. The same is true of the corresponding elements associated with chute 20 and hopper door 24.

What is claimed is:

1. An apparatus for opening, closing and locking pairs of hopper doors of a railroad hopper car of the type having a longitudinal center sill and pairs of longitudinally extending first and second chutes, said first and second chutes of a pair being located opposite each other on each side of said center sill and being configured to discharge lading to each side of said hopper car, a first door for said first chute and a second door for said second chute of a pair, each of said first and second doors being swingable between a downwardly depending open position and a closed position closing its respective chute, said apparatus for each pair of hopper doors comprising first and second shafts, said first and second shafts being rotatively mounted on the underside of said first and second chutes of said pair respectively, with their end portions extending beyond their respective chutes and their axes parallel to said center sill, an operating cam being non-rotatively affixed to each end portion of each of said first and second shafts, a connecting link pivotablly joining said operating cams on corresponding end portions of said first and second shafts, a door actuating link pivotally connecting each of said operating cams to the adjacent one of said first and second hopper doors, a toothed ratchet wheel being non-rotatively affixed to a corresponding end portion of each of said first and second shafts, a ratchet pawl being pivotally supported on each of said first and second chutes to cooperate with the adjacent one of said ratchet wheels, means connecting said ratchet pawls such that both ratchet pawls are manually shiftable between a ratchet wheel engaging position and a ratchet wheel releasing position simultaneously from either side of said hopper car, each of said first and second shafts and its respective operating cams being rotatable between a door-open position and an over-center, door-closed position, means in association with at least one of said operating cams on each of said first and second shafts for engagement of either of said operating cams by an appropriate tool to rotate said tool engaged operating cam and its respective one of said first and second shafts to said door-open position and rotating the other of said first and second shafts to said door-open position by means of said connecting links, and means engageable by an appropriate tool mounted on at least one end portion of each of said first and second shafts for manual rotation of said shafts individually to said over-center, door-closed positions.

2. The apparatus claimed in claim 1 wherein each of said connecting links comprises a pair of first and second elongated link members, adjustable means joining one end of said first link member to one end of the second link member to form said connecting link and render it adjustable in length, the free end of said first link member having a slot through which a pivot pin mounted on an operating cam of said first shaft extends, the free end of said second link member having a slot through which a pivot pin mounted on the corresponding one of the operating cams of said second shaft extends.

3. The apparatus claimed in claim 2 wherein said means connecting said ratchet pawls comprises a transfer lever pivotally mounted on said center sill, a first link pivotally connected at one of its ends to one end of said transfer lever and at the other of its ends to one of said ratchet pawls, and a second link pivotally connected at one of its ends to the other end of said transfer lever and at the other of its ends to the other of said ratchet pawls.

4. The apparatus claimed in claim 3 wherein each of said operating cams at each end of said first and second shafts has a first arm to which one end of its respective door actuating link is pivotally attached, each operating cam having a second arm to which one end of its respective connecting link is pivotally attached, and at least two of said operating cams mounted on corresponding ends of said first and second shaft each having a third arm engageable by said tool for rotating said operating cam to said door-open position.

5. The apparatus claimed in claim 4 wherein said means on each of said first and second shafts engageable by an appropriate tool to rotate said shafts to said over-center, door-closed position comprises a hollow cylindrical capstain mounted on one end of its respective shaft, said capstain having a plurality of holes about its periphery for receipt of the end of said last mentioned tool, said last mentioned tool comprising an elongated bar-like tool.

6. The apparatus claimed in claim 5 including a single arm non-rotatively affixed to each of said first and second shafts adjacent each of said operating cams, said arm corresponding to and being in parallel spaced relationship to said second cam arm, a pivot pin mounted in said second cam arm and said single arm near the free ends thereof and passing through an elongated perforation in one end of its respective connecting link.

7. The apparatus claimed in claim 6 wherein each of said third arms of said at least two operating cams terminates in a prying surface, a bracket mounted on the adjacent chute, said bracket having a portion cooperating with said prying surface when said operating cam is in said over-center, door-closed postion to form a socket with said pyring surface into which the end of said tool, comprisng a pry bar, can be inserted to exert a prying force on said prying surface of said operating cam to rotate said operating cam to said door-open position.

8. The apparatus claimed in claim 7 wherein said hopper car has two of said pairs of chutes and an opening, closing and locking apparatus for each of said chute pairs, said ratchet wheel, said tool engageable operating cam and said tool engageable means for shaft rotation being mounted on that end of each first shaft and each second shaft extending toward an end of said hopper car.

9. The apparatus claimed in claim 2 wherein said ends of said link elements which are joined together are off-set with respect to the remainder of their respective link element and are overlapped, said overlapped link ends having corresponding holes therein for receipt of bolts, the holes in at least one of said overlapped ends being elongated along the long axis of their respective link element.

10. The apparatus claimed in claim 1 wherein said means connecting said ratchet pawls comprises a transfer lever pivotally mounted on said center sill, a first link pivotally connected at one of its ends to one end of said transfer lever and at the other of its ends to one of said ratchet pawls, and a second link pivotally connected at one of its ends to the other of said transfer lever and at the other of its ends to the other of said ratchet pawls.

11. The apparatus claimed in claim 10 wherein each of said first and second links terminates at one of its ends in a clevis with a pivot pin passing through a perforation in the adjacent end of said transfer lever, and terminates at the other of its ends in a clevis having a pivot pin extending through an elongated slot in the adjacent one of said ratchet pawls, at least one clevis on each link being adjustably mounted thereon to enable adjustment of the effective length of said link.

12. The apparatus claimed in claim 1 wherein each of said operating cams at each end of said first and second shafts has a first arm to which one end of its respective door actuating link is pivotally attached, each operating cam having a second arm to which one end of its respective connecting link is pivotally attached, and at least two of said operating cams mounted on corresponding ends of said first and second shaft each having a third arm engageable by said tool for rotating said operating cam to said door-open position.

13. The apparatus claimed in claim 12 including a single arm non-rotatively affixed to each of said first and second shafts adjacent each of said operating cams, said arm corresponding to and being in parallel spaced relationship to said second cam arm, a pivot pin mounted in said second cam arm and said single arm near the free ends thereof and passing through an elongated perforation in one end of its respective connecting link.

14. The apparatus claimed in claim 12 wherein each of said third arms of said at least two operating cams terminates in a prying surface, a bracket mounted on the adjacent chute, said bracket having a portion cooperating with said prying surface when said operating cam is in said over-center, door-closed position to form a socket with said pyring surface into which the end of said tool, comprising a pry bar, can be inserted to exert a prying force on said prying surface of said operating cam to rotate said operating cam to said door-open position.

15. The apparatus claimed in claim 1 wherein said means on each of said first and second shafts engageable by an appropriate tool to rotate said shafts to said over-center, door-closed position comprises a hollow cylindrical capstain mounted on one end of its respective shaft, said capstain having a plurality of holes about its periphery for receipt of the end of said last mentioned tool, said last mentioned tool comprising an elongated bar-like tool.

16. The apparatus claimed in claim 1 wherein said hopper car has two of said pairs of chutes and an opening, closing and locking apparatus for each of said chute pairs, said ratchet wheel, said tool engageable operating cam and said tool engageable means for shaft rotation being mounted on that end of each first shaft and each second shaft extending toward an end of said hopper car.

* * * * *